United States Patent [19]

Padgett

[11] Patent Number: 5,072,869

[45] Date of Patent: Dec. 17, 1991

[54] COMPUTER PAPER TAB STRIPPER

[76] Inventor: Richard M. Padgett, 6130 Whitsett Ave., North Hollywood, Calif. 91606

[21] Appl. No.: 637,737

[22] Filed: Jan. 7, 1991

[51] Int. Cl.[5] ..... B26F 3/02

[52] U.S. Cl. ..... 225/106; 225/93

[58] Field of Search ..... 225/93, 106, 1

[56] References Cited

U.S. PATENT DOCUMENTS

| | | | |
|---|---|---|---|
| 2,782,856 | 2/1957 | Staley | 30/363 |
| 3,986,479 | 10/1976 | Bonk | 118/506 |
| 4,886,198 | 12/1989 | de Larosiere | 225/106 |

*Primary Examiner*—Mark Rosenbaum
*Assistant Examiner*—John M. Husar
*Attorney, Agent, or Firm*—John J. Posta, Jr.

[57] ABSTRACT

The computer paper tab stripper has an elongated preferably generally rectangular block with a flat bottom, preferably with a non-slip rubber tread or the like, a flat top spaced above the bottom and interconnecting two opposite sidewalls and two opposite endwalls. Preferably, the length of stripper is slightly less than that of a computer paper to be stripped of its tab so that the tab ends stick out of opposite ends of the stripper and are easy to grip. One of the sidewalls is sloped to form a side ramp of preferably about incline 45° to enable the computer paper to be slid up the ramp easily and over a spaced array of vertical pins in the top, which pins are adapted to fit through openings in the computer paper tab. The pins preferably include a truncated cone portion. An elongated preferably rectangular top lid is hinged to the top of the block on the side opposite the ramp and is adapted to move between a lid-up position and a lid-down position. The lid has recesses matching the pins so as to receive the pins when in the lid-down position. In the lid-down position, the lid preferably is tilted or canted and makes point contact with the block top for easy gripping. The block may be drilled for tie-down screws or both or be free-stnding. The stripper is preferably of metal and is compact and efficient.

9 Claims, 1 Drawing Sheet

COMPUTER PAPER TAB STRIPPER

BACKGROUND OF THE INVENTION

1. Field of the Invention

The present invention generally relates to paper handlers and more particularly to an improved computer paper tab stripper.

2. Prior Art

Various devices are available for shredding, stripping and otherwise processing paper. See, for example, U.S. Pat. No. 3,190,516 for handling multiple carbon forms. Certain of such devices have been utilized to strip off perforated side margins from computer paper and the like. See, for example, U.S. Pat. Nos. 4,529,113, 4,657,163 and 4,782,986. Generally, such devices have either been complicated and expensive and/or have not made the stripping easy and positive, but have resulted in a danger of tearing the computer paper.

There remains a need for an improved side margin or tab stripper for computer paper, which stripper will be simple, inexpensive and efficient and which will permit the positive stripping off of the side margin without ripping the rest of the computer paper.

SUMMARY OF THE INVENTION

The improved computer paper tab stripper of the present invention satisfies all the foregoing needs. The stripper is substantially as set forth in the Abstract of the Disclosure.

Thus, the stripper comprises an elongated generally rectangular base block with a horizontal bottom and horizontal top, two interconnecting upraised sidewalls and two upraised endwalls. The bottom preferably has a resilient non-slip tread on it of rubber or plastic or the like. The top has a spaced array of vertical pins protruding upwardly therefrom along the length of the block and adapted to receive the holes of a computer paper tab. Preferably, the pins are frusto-conical with flat tops to facilitate engagement of the pins with the holes. Moreover, one side of the block has an inclined ramp, preferably at an angle of about 45°, so that the computer paper tab can be slid easily up the ramp and guided thereby over the pins for easy engagement therewith.

The stripper also includes an elongated preferably generally rectangular lid hingedly connected to the block top adjacent the side opposite that having the ramp. The lid is movable between a lid-up open position and a lid-down closed position. The lid has on the underside thereof a plurality of recesses matching the pins and adapted to receive the pins when the lid is down. The lid is preferably canted so that when closed it has a single line contact with the top, providing, in effect, a knife edge to help the user easily rip off the computer tab hooked on the pins. The block may be drilled for permanent mounting to a desk, table, etc., or can be free-standing. Preferably, the lid and block, as well as the pins and hinges are of durable metal. The stripper is simple, inexpensive, efficient, durable and easy to use.

Further features of the invention are set forth in the following detailed description and accompanying drawings.

DRAWINGS

DETAILED DESCRIPTION

Figure 1:
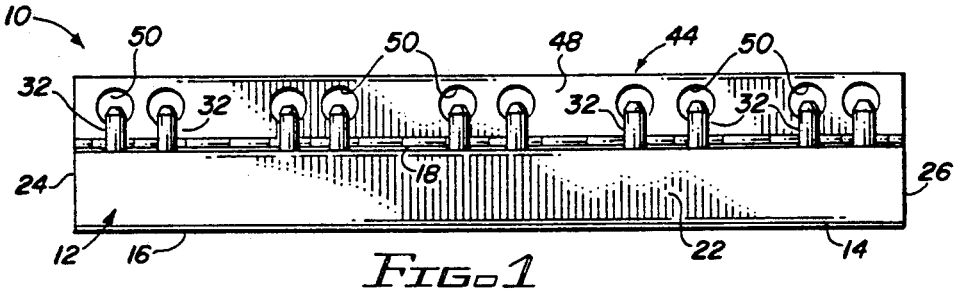
FIG. 1 is a schematic side elevation of a first preferred embodiment of the improved computer paper tab stripper of the present invention, shown with the lid thereof in the open position.

FIGS. 1–7.

Now referring more particularly to FIGS. 1–7 of the drawings, an improved computer paper tab stripper is shown. Thus, stripper 10 is illustrated which is preferably of metal, such as steel or aluminum, and comprises an elongated generally rectangular block 12 having a horizontal bottom 14 to which is connected a non-slip rubber or plastic tread 16 or the like, a horizontal top 18 spaced above bottom 14 and interconnecting sidewalls 20 and 22 and endwalls 24 and 26.

It will be noted that sidewall 22 is sloped, preferably at about 45° from vertical, to form a ramp 30 upon which to slide computer paper when using stripper 10 as hereinafter described.

Projecting generally vertically upwardly from top 18 and connected thereto are a plurality of preferably frusto-conical spaced pins 32. Pins 32 are arranged in spaced pairs along the length of top 18 as shown in FIGS. 1 and 5, the two opposite end pairs of pins 32 being very close to endwalls 24 and 26, respectively, so that when computer paper 34 (FIG. 5) with track holes 36 in the side tab 38 thereof is run up ramp 30 and tab 38 thereof is slid over and down into pins 32 so that pins 32 protrude up through holes 36, tab ends 40 and 42 will protrude beyond endwalls 24 and 26, respectively, and permit easy gripping and removal of tab 38 from stripper 10 after tab 38 is separated from paper 34 as hereinafter described.

Pins 32 have a frusto-conical top end with flat tops and angled sides to facilitate sliding of tab 38 thereover. For this purpose, they are of a preselected height and spaced a preselected distance from ramp 30 so that as paper 34 is slid up ramp 30, it will be turned upwardly to contact the conical side of pins 32, to then slide up and over the flat tops of pins 32, after which paper 34 can be tilted to a horizontal position to have the holes 36 in paper 34 drop over and engage pins 32 in holes 36.

Figure 2:
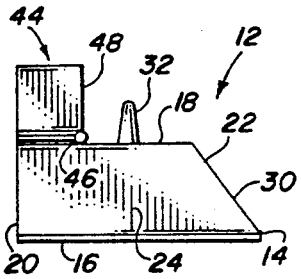
FIG. 2 is a schematic end view of the stripper of FIG. 1, shown with the lid thereof in the open position.
Figure 3:
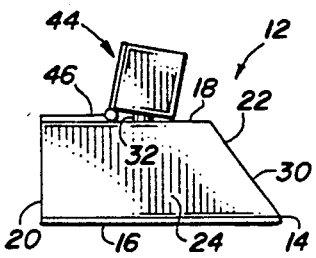
FIG. 3 is a schematic end view of the stripper of FIG. 1, shown with the lid thereof in the closed position.
Figure 6:
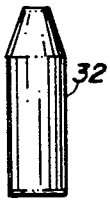
FIG. 6 is an enlarged schematic side elevation of a pin of the stripper of FIG. 1; and, FIG. 7 is an enlarged schematic top plan view of the pin of FIG. 6.
Figure 7:
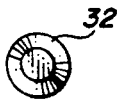
Figure 4:
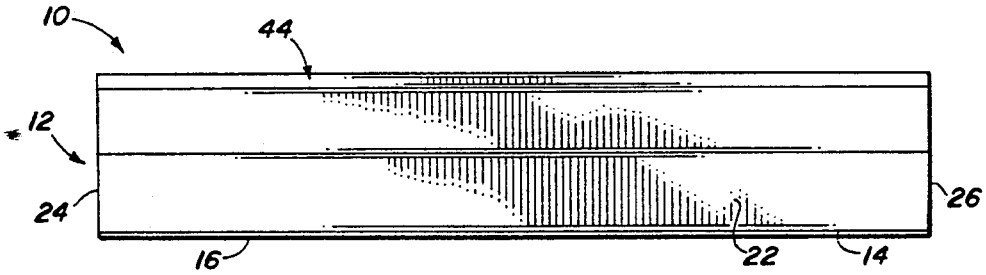
FIG. 4 is a schematic side elevation of the stripper of FIG. 1, shown with the lid thereof in the closed position.
Figure 5:
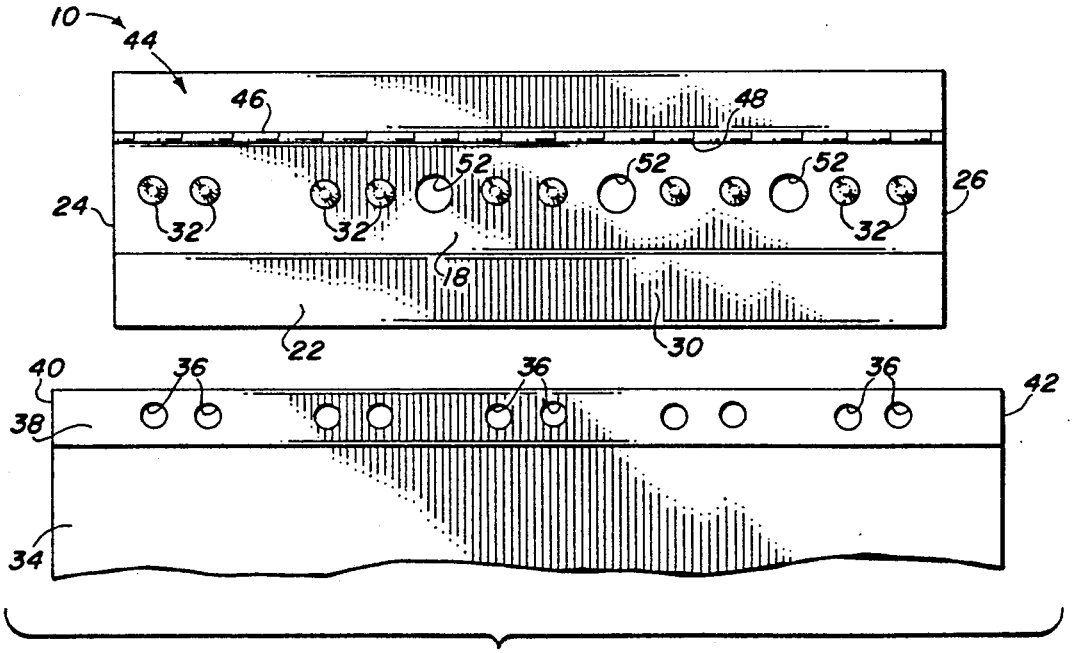
FIG. 5 is a schematic top plan view of the stripper of FIG. 1, shown in the lid open position.

Stripper 10 also includes a preferably rectangular elongated lid 44 running the length of block 12 and hinged to top 18 near sidewall 20 by hinges 46 so as to be easily moved between a raised lid-up position shown in FIGS. 1, 2 and 5 and a closed lid-down position shown in FIGS. 3 and 4. The underside 48 of lid 44 has a plurality of conical recesses 50 spaced along the length thereof and adapted to receive pins 32 when lid 44 is closed (e.g., FIG. 3).

It will be noted that in the lid-up position, lid 44 is about horizontal and above top 18, but in the lid down position, lid 44 is canted over or tilted over from the horizontal so as to strike top 18 in a single point (line)

contact, which helps to fix tab 38 in place and facilitate its removal from paper 34.

In this regard, after lid 44 is in the up position, tab 38 is slid up ramp 30 and over pins 32 and then down to engage pins 32 and holes 36. Then lid 44 is closed. Paper 34 is then pulled away from stripper 10 while holding both paper 34 and stripper 10. Tab 38 is thus easily separated from paper 34, after which lid 44 is opened, tab 38 is gripped by either overlapping end 40 or 42 and pulled up and over pins 32 and discarded. Tearing and ripping of paper 34 does not occur. Non-skid tread 16 allows stripper 10 to be used as a desk top device. Alternatively, it can be provided with vertical holes 52 through top 18 and bottom 14 through which screws (not shown) can be inserted to permanently mount stripper 10 to a flat surface (not shown).

Thus, stripper 10 is compact, efficient, inexpensive, durable and easy to use. It can be made in a variety of sizes, and pin configurations to match tab holes of various computer papers. Various other modifications, changes, alterations and additions can be made in the improved stripper of the present invention, its components and parameters. All such modifications, changes, alterations and additions as are within the scope of the appended claims form part of the present invention.

What is claimed is:

1. An improved paper tab stripper, said stripper comprising, in combination:

a) an elongated block having a flat bottom, a flat top spaced from said bottom and interconnecting opposite sidewalls and endwalls, one of said two sidewalls being sloped to provide an inclined ramp between said top and said bottom, said block having a plurality of straight pins spaced along the length thereof and protruding upwardly from said top, said pins having a lower portion of a substantially constant cross-sectional area of substantially the same size as the holes in the computer paper tab and further having an upper portion formed into a truncated cone; and, b) an elongated solid lid hinged to said top along substantially the length of said top and having a plurality of recesses significantly greater than the cross-sectional area of said pins which are spaced along the length thereof and registrable with said pins, said lid being rotatable between a lid-up position away from said pins and a lid-down position wherein said pins are in said recesses.

2. The improved stripper of claim 1 wherein said lid is hinged to said top adjacent said sidewall opposite said ramp.

3. The improved stripper of claim 1 wherein said bottom has a non-skid surface.

4. The improved stripper of claim 1 wherein said block has mounting holes spaced along the length thereof and extending vertically therethrough from said top to said bottom.

5. The improved stripper of claim 1 wherein said pins include truncated cones to facilitate sliding of a computer paper tab thereover.

6. The improved stripper of claim 1 wherein said ramp has an about 45° slope and said pins are of preselected height and spacing from said ramp whereby computer tab paper can be slid on said ramp to contact and slide up the side of the truncated cones until holes in the computer paper overlie the pins and drop down over said pins.

7. The improved stripper of claim 6 wherein said block pins and lid are of metal, and wherein said lid has a substantially parallel top and bottom and substantially parallel sides lying substantially perpendicular to said top and bottom, and when in said lid-down position has a point contact with said top at the intersection of one of said sides and the bottom for easy tab gripping.

8. The improved stripper of claim 1 wherein said block and lid are generally rectangular, wherein said top is horizontal and wherein said lid in said lid-down position is canted from the horizontal position to make point contact with said horizontal top.

9. The improved stripper of claim 1 wherein said stripper is of preselected length and said pins are disposed therein such that when a computer paper is fitted thereover, the tab of said paper extends beyond said opposite endwalls for easy gripping and removal thereof.

* * * * *